US007771489B2

(12) United States Patent
Hueffer et al.

(10) Patent No.: US 7,771,489 B2
(45) Date of Patent: Aug. 10, 2010

(54) FORMULATION FOR USE IN CHROME OR CHROME-FREE TANNAGE

(75) Inventors: Stephan Hueffer, Ludwigshafen (DE); Stefan Schroeder, Neuleiningen (DE); Einhard Wagner, Speyer (DE); Thorsten Raedler, Ludwigshafen (DE); Karl Vill, Korschenbroich (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 776 days.

(21) Appl. No.: 10/524,047

(22) PCT Filed: Aug. 8, 2003

(86) PCT No.: PCT/EP03/08830

§ 371 (c)(1),
(2), (4) Date: Oct. 13, 2005

(87) PCT Pub. No.: WO2004/022790

PCT Pub. Date: Mar. 18, 2004

(65) Prior Publication Data

US 2006/0101584 A1 May 18, 2006

(30) Foreign Application Priority Data

Aug. 14, 2002 (DE) ..... 102 37 259

(51) Int. Cl.
*C14C 3/08* (2006.01)
*C14C 3/10* (2006.01)
*C14C 3/16* (2006.01)
*C14C 3/22* (2006.01)

(52) U.S. Cl. ..... 8/94.19 R; 8/94.33

(58) Field of Classification Search ..... 8/94.1 R, 8/94.19 R, 94.33
See application file for complete search history.

(56) References Cited

U.S. PATENT DOCUMENTS 2,992,936 A * 7/1961 Rowland ..... 106/486
3,053,697 A * 9/1962 Mauthe et al. ..... 428/540
3,719,514 A * 3/1973 Taylor ..... 106/208.4
4,272,242 A * 6/1981 Plapper et al. ..... 8/94.18
5,102,422 A * 4/1992 Christner et al. ..... 8/94.15
6,033,590 A * 3/2000 Komforth et al. ..... 252/8.57
6,759,463 B2 * 7/2004 Lorah et al. ..... 524/445
2002/0192366 A1 * 12/2002 Cramer et al. ..... 427/180

FOREIGN PATENT DOCUMENTS

| | | |
|---|---|---|
| CN | 1 344 751 | 4/2002 |
| DE | 969 689 | 7/1958 |
| DE | 1 263 978 | 3/1968 |

OTHER PUBLICATIONS

Lakshminarayana, Y. et al. "A Novel Water Dispersable Bentonite—Acrylic Graft Copolymer as Filler Cum Retanning Agent", Journal of the American Leather Chemists Association, vol. 97, No. 1, pp. 14-22, XP009020542 2002.
Roempp Chemie Lexikon, 9$^{th}$ edition, p. 1538 1995.
Roempp Chemie Lexikon, 9$^{th}$ edition, p. 1541 1995.
Herfeld, H. Bibliothek des Leders, vol. 3, Umschau Verlag, 2$^{nd}$ edition, p. 237 1990.

* cited by examiner

*Primary Examiner*—Lorna M Douyon
*Assistant Examiner*—Amina Khan
(74) *Attorney, Agent, or Firm*—Oblon, Spivak, McClelland, Maier & Neustadt, L.L.P.

(57) ABSTRACT

A formulation for use in chrome-free or chrome tanning is proposed, comprising a clay mineral which, after vigorous stirring for 30 minutes in water at 50° C., has a number average particle diameter of less than 2 μm or a bimodal size distribution with a first, finely divided fraction whose number average particle diameter is less than 0.5 μm and a second, coarser fraction whose number average particle diameter is less than 5 μm, determined in each case by the method according to ISO 13320-1, by combined laser light diffraction and light scattering, the amount of the first, finely divided fraction being from 10 to 90% by weight, and one or more substances from one or more of the following groups: organic polymers, aldehyde tanning agents, sulfone tanning agents, resin tanning agents, phenol tanning agents, fatliquoring agents, vegetable tanning agents, dyes and pigments.

14 Claims, No Drawings

FORMULATION FOR USE IN CHROME OR CHROME-FREE TANNAGE

The present invention relates to a formulation for use in chrome-free and chrome tanning, comprising a clay mineral, and a use of clay minerals.

In tanning, readily perishable animal hide substance is processed by preparatory treatment with tanning assistants, chemical reaction with tanning agents and appropriate finishing to give resistant leather which remains soft and supple and has the desired performance characteristics (cf. Römpp Chemie Lexikon, 9th edition, 1995, page 1538). The high water content stabilizing the collagen structure of the original hide substance is reduced thereby and irreversible stabilization is realized by crosslinking by means of tanning agents. A distinction is made between inorganic, mineral and organic chemical tanning agents. Inorganic tanning agents are mainly chromium(III) salts, polyphosphates and aluminum, zirconium and iron salts. Organic tanning agents may be of synthetic or vegetable origin (cf. Römpp Chemie Lexikon, 9th edition, page 1541).

Inorganic polymers have been known to date in tanning as a rule as fillers. According to the opinion described in H. Herfeld: Bibliothek des Leders, Volume 3, Umschau Verlag, Frankfurt, $2^{nd}$ edition, 1990, page 237, inorganic fillers have no tanning effect. These include kaolin, finely divided clay (china clay), colloidal silica, etc. These products are deposited in the loosely structured main parts and preferably in the flesh side. There is very little effect on the grain structure, the buffability is often improved and the plush is shorter.

However, the disadvantage here was that the very loose binding or the superficial incorporation in the hide substance. In subsequent process steps of leather production, for example milling, a considerable proportion of incorporated substances was therefore liberated again and led to clogging of the grain or to abrasive damage to the grain structure.

DE-C 969689 describes the use of surface-active silicon-containing fillers, in particular of silica and/or of silicates in colloidal form, having a particle size of from 0.1 to 1 μm, for leveling, shortening and refining the buffed surface of in particular suede leathers. These silicon-containing colloid dusts are intended to be strongly absorbed on the collagen fibers, with the result that the incorporation is to be substantially maintained even during subsequent operations. However, colloidal silica, silicates or mixtures thereof have the disadvantage, as dynamic systems, of being subject to continuous change. During this change, an increase in the size of the initially incorporated particles to give sand-like agglomerates occurs during storage or during the use of the leather/leather goods owing to Ostwald ripening. Consequently, abrasive damage to the leather is caused for example in the walking creases of upper leathers by drumming. This silicate tanning is therefore considered to be comparatively unstable.

The technical article by Y. Lakshminarayana et al. in JALCA 97 (2002), 14 to 21, describes the use of bentonites for the preparation of graft polymers with methacrylic acid for use in tanning, in particular in the aftertreatment of chrome-tanned leather.

It is an object of the present invention to provide a stable formulation comprising a clay mineral for use in chrome-free and chrome tanning, which formulation ensures improved properties of the leather obtained thereby and an improvement in the process.

We have found that this object is achieved by a formulation for use in chrome-free and chrome tanning, comprising a clay mineral which, after vigorous stirring for 30 minutes in water at 50° C., has a number average particle diameter of less than 2 μm or a bimodal size distribution with a first, finely divided fraction whose number average particle diameter is less than 0.5 μm and a second, coarser fraction whose number average particle diameter is less than 5 μm, determined in each case by the method according to ISO 13320-1, by combined laser light diffraction and light scattering, the amount of the first, finely divided fraction being from 10 to 90% by weight, and one or more substances from one or more of the following groups: organic polymers, aldehyde tanning agents, sulfone tanning agents, resin tanning agents, phenol tanning agents, fatliquoring agents, vegetable tanning agents, dyes and pigments.

It has surprisingly been found that the use of clay minerals which, after delamination by vigorous stirring in warm water, have a number average particle diameter of less than 2 μm or a bimodal size distribution with a first, finely divided fraction whose number average particle diameter is less than 0.5 μm and a second, coarser fraction whose number average particle diameter is less than 5 μm, the amount of the first, finely divided fraction being from 10 to 90% by weight, as tanning agents or for the preparation of tanning agents leads to a substantial improvement in the properties of the leather obtained thereby. A treatment with a sufficient amount, as a rule about 950 ml, of water, based on 50 g of the clay mineral, at 50° C. with vigorous stirring, for example at 250 rpm, for 30 minutes is required for delamination for the determination of the number average particle diameter, the clay mineral being dispersed in the water. This treatment is intended to ensure that the clay mineral is delaminated until the particle size no longer changes.

The particle sizes and particle size distribution were determined according to ISO 13320-1 by combined laser light diffraction and light scattering using a Malvern 2000 analysis instrument from Malvern.

It is assumed that the interaction of the clay minerals with the collagen chains of the hide is essential for the action of the clay minerals having the particle sizes defined above. This interaction is possible, for example, via hydrogen bridges between collagen and the surface hydroxyl groups of the clay minerals. It has surprisingly been found that clay minerals having the defined particle sizes are irreversibly incorporated in the hide.

Clay minerals are weathering products of primary aluminosilicates, i.e. of compounds comprising different proportions of alumina and silica. Silicon is surrounded tetrahedrally by four oxygen atoms, while aluminum is present in octahedral coordination. Clay minerals very predominantly belong to the phyllosilicates, also referred to as sheet silicates or leaf silicates, but in some cases also to the band silicates (cf. Römpp Chemie Lexikon, 9th edition, 1995, pages 4651 and 4652).

For the novel formulations, it is particularly advantageous if the clay mineral is a phyllosilicate. The phyllosilicate may preferably be a kaolinite, muscovite, montmorillonite, smectite or bentonite, in particular a hectorite.

Particularly good results are obtained if substances which, owing to their chemical structure, are capable of forming strong hydrogen bridge bonds with the clay minerals, in particular urea or urea derivatives, alcohols, polyols, propylene carbonate, organic amides, urethanes, saccharides or derivatives of saccharides, in particular nitrocellulose, sulfite cellulose or ethylhexylcellulose, are added to the clay minerals before or during the use thereof as tanning agents. By means of this treatment, inter alia, delamination of the clay mineral, in particular sheet silicate, is promoted.

Organic polymers which may be used in the novel formulations are, for example, polymethacrylates, polyacrylates, maleic anhydride/styrene copolymers or maleic anhydride isobutene copolymers.

Formulations wherein the clay mineral has a number average particle diameter of less than 1 μm are preferred.

A formulation comprising a clay mineral which, after vigorous stirring for 30 minutes in water at 50° C., has a number average particle diameter of less than 2 μm or a bimodal size distribution with a first, finely divided fraction whose number average particle diameter is less than 0.5 μm, determined by the method according to ISO 13320-1, by combined laser light diffraction and light scattering, and a second, coarser fraction whose number average particle diameter is less than 5 μm, the amount of the first, finely divided fraction being from 10 to 90% by weight, is particularly suitable and the aldehyde tanning agent is glutaraldehyde or a derivative of glutaraldehyde, in particular an acetal.

The present invention also relates to a use of clay mineral which, after vigorous stirring for 30 minutes in water at 50° C., has a number average particle diameter of less than 2 μm or a bimodal size distribution with a first, finely divided fraction whose number average particle diameter is less than 0.5 μm and a second, coarser fraction whose number average particle diameter is less than 5 μm, the amount of the first, finely divided fraction being from 10 to 90% by weight, as tanning agents or for the preparation of tanning agents.

The use of clay minerals having a number average particle diameter of less than 1 μm is preferred.

A use wherein substances which, owing to their chemical structure, are capable of forming strong hydrogen bridge bonds with the clay mineral, in particular urea or urea derivatives, alcohols, polyols, propylene carbonate, organic amides, urethanes, saccharides or derivatives of saccharides, in particular nitrocellulose, sulfite cellulose or ethylhexylcellulose, are added to the clay minerals before or during the use thereof as tanning agents is advantageous.

The clay mineral used is preferably a phyllosilicate, particularly preferably a kaolinite, muscovite, montmorillonite, smectite or bentonite, in particular a hectorite.

Said clay minerals can preferably be used by employing them as tanning agents or for the preparation of tanning agents for preliminary tanning, in particular for chrome-free preliminary tanning.

Further preferred use is one wherein the clay minerals are used as tanning agents or for the preparation of chrome or chrome-free tanning agents for retanning.

The following advantages are achieved with the novel formulations and by the novel use:

In particular, a significantly improved selective filling effect is achieved, i.e. loose regions are preferably filled, with the result that an improvement in the leather quality and surface yield is achieved.

The grain tightness is considerably improved, i.e. creasing or spliceability on the surface is considerably reduced or avoided.

The leather quality is also increased by the improved embossability.

Moreover, the leather quality is improved by an increase in the tensile strength.

An important quality feature in the preliminary tanning, in particular in the case of chrome-free leathers, is the shaveability of the semifinished product. This is improved by the invention, resulting in improved surface characteristics and a level thickness of the shaved hide and reduced tool wear, in particular knife wear, during the shaving process. The time gain owing to the improved processability due to the reduced adhesion of the shaving knife is also considerable.

According to the invention, the fat distribution of both natural and applied fat is improved, resulting in a more even and more regular surface. The improvement in the levelness of fat distribution moreover makes it possible to save up to 50% of the fatliquoring agent in the retanning and thus to provide particularly environmentally compatible tanning processes with correspondingly low wastewater pollution.

A substantial disadvantage of the process is the significant improvement in the environmental compatibility by virtue of the fact that the liquor exhaustion, in particular with respect to the fatliquoring agent, is improved by up to 50% with a correspondingly lower wastewater pollution.

The invention is explained in more detail below with reference to examples:

EXAMPLES E1.1 TO E1.4 AND COMPARATIVE EXAMPLES C1.0 TO C1.4 PRELIMINARY TANNING OF WET WHITE

The trade grades mentioned below under their trade names are products from BASF AG, Ludwigshafen.

Pickled hide strips split to a thickness of from 1.6 to 1.8 mm and each weighing 250 g were treated together with 200 g of water in each case at a pH of 3.0 at 25° C. in succession with 3% of aqueous glutaraldehyde solution (Relugan® GT 24) for 60 minutes and then with 4% of the sulfone tanning agent Basyntan® SW. After a drumming time of 90 minutes, the pH was increased to 3.8 to 4.0 with a mixture of 2 parts by weight of Tamol® NA and sodium formate.

In comparative examples C1 to C1.4 and examples 1.1 to 1.4, 10 g of the clay minerals mentioned in table 1 below were added in each case to the liquors together with the glutaraldehyde solution. The mean particle sizes of the clay minerals were determined by laser diffraction/light scattering on freshly prepared suspensions having a solids content of 5% in each case, according to ISO 13320-1.

After the preliminary tanning, in each case 100 g of each liquor were coarsely filtered through a 25 μm filter. The remaining solids content was sedimented in a centrifuge, washed, dried and then weighed.

Table 1 below shows the solids contents of the liquor after the tanning process, based in each case on the original total liquor. The shaveability of the leather subjected to preliminary tanning was rated on a scale from 1 to 5. The shrinkage temperature was determined according to DIN 53336, which was modified in the following points as mentioned below:

- Point 4.1: the specimen had the dimensions 3 cm·1 cm and the thickness was not determined;
- Point 4.2: instead of 2 specimens, only one specimen was tested per leather sample;
- Point 6: omitted;
- Point 7: the drying in a desiccator under reduced pressure was omitted and
- Point 8: the shrinkage temperature was read when the pointer moved back.

TABLE 1

| | Clay mineral | Mean particle size [μm] | Solids content of liquor [g] | Shaveability [Rating 1-5] | Shrinkage temperature [° C.] |
|---|---|---|---|---|---|
| C 1.0 | — | — | — | 3 | 79 |
| C 1.1 | Kaolin | 13.2 | 3.8 | 3.5 | 77 |
| C 1.2 | Kaolin | 7.6 | 2.9 | 3 | 78 |
| C 1.3 | Kaolin | 5.1 | 2.7 | 2.5 | 78 |
| C 1.4 | Kaolin | 3.2 | 1.4 | 2.5 | 79 |
| E 1.1 | Kaolin | 1.3 | 0.55 | 1.5 | 81 |
| E 1.2 | Montmorillonite | 0.6 | 0.30 | 1 | 83 |
| E 1.3 | Kaolin/ montmorillonite | bimodal 0.6/3.2 | 0.7 | 1 | 82 |
| E 1.4 | Kaolin/ bentonite | 0.2/1.3 | 0.35 | 1 | 82 |

The comparison of the results of comparative experiments C1.0 to C1.4 and of the examples according to the invention E1.1 to E1.4 shows a substantial reduction in the solids content of the liquor after the tanning process (fourth column in table 1), i.e. a substantial improvement in the liquor exhaustion, and an improvement in the shaveability (5th column) and the shrinkage temperature (last column).

COMPARATIVE EXAMPLES C2.0 AND C2.1 AND EXAMPLES E2.1 AND E2.2 RETANNING OF WET BLUE UPPER LEATHER

A commercial Zebu wet blue leather was shaved to a thickness of from 1.8 to 2.0 mm and divided into quarters. Thereafter, 2% of sodium formate and 0.4% of sodium bicarbonate as well as 1% of Tamol® NA were added to the quarters in a drum and at a liquor length of 200%, i.e. a liquor of 2 kg of aqueous phase to 1 kg of leather, at intervals of 10 minutes. After 90 minutes, the liquor was discharged and the Zebu quarters were distributed over four separate drums.

In comparative example 2.0, a 1% strength aqueous solution of the dye Luganil® brown was metered at 25° C. into one of the drums and the Zebu quarter was drummed for 10 minutes.

Thereafter, 3% of polymer tanning agent Relugan® RV, 5% of sulfone tanning agent Basyntan® DLX and 2% of resin tanning agent Relugan® DLF were added and drumming was effected again for 20 minutes at 10 rpm.

Thereafter, the hide was treated for 40 minutes with 3% of commercial mimosa vegetable tanning agent and then for a further 40 minutes with 2% of mimosa vegetable tanning agent.

Acidification was then effected with formic acid to a pH of from 3.6 to 3.8. After 20 minutes, the liquor was discharged and washing was effected with 200% of water. Finally, 5% of Lipodermlicker® CMG and 2% of Lipodermlicker® PN were metered in 100% of water at 50° C. After a drumming time of 45 minutes, acidification was effected with 1% strength formic acid.

The washed leather was dried and staked and the quality was assessed with respect to body, grain tightness, softness and levelness of the dyeing/fatliquoring according to a rating system from 1 (very good) to 5 (unsatisfactory). Moreover, the tensile strength in Newton according to DIN 53328 and the stitch tear resistance in Newton according to DIN 53331 were determined. The comparison of the values for the chemical oxygen demand (COD) confirms the improved liquor exhaustion with the novel clay minerals.

In comparison with comparative example 2.0, in comparative example 2.1 a clay mineral corresponding to comparative example 1.1, i.e. kaolin having a further particle size of 13.2 μm, was metered in in a concentration of 4% together with the sulfone tanning agent Basyntan® DLX.

In comparison, in each case 4% of the clay minerals corresponding to examples E1.1 and E1.4 were metered in in examples E2.1 and E2.2.

Table 2 below shows a substantial quality improvement with respect to body, grain tightness, softness, levelness of the dyeing/fatliquoring and with respect to tensile strength and stitch tear resistance of the leathers obtained in examples E2.1 and E2.2 according to the invention compared with comparative examples C2.0 and C2.1.

TABLE 2

| | Clay mineral | Body | Grain tightness | Softness | Tensile strength [N] | Stitch tear resistance [N] | Levelness Dyeing/ Fatliquoring | COD [mg $O_2$/l liquor] |
|---|---|---|---|---|---|---|---|---|
| C 2.0 | — | 3 | 3.5 | 3 | 428 | 302 | 3 | 16 200 |
| C 2.1 | C 1.1 | 3 | 3 | 3.5 | 410 | 292 | 2.5 | 14 800 |
| E 2.1 | E 1.1 | 2 | 2.5 | 2 | 452 | 319 | 1 | 10 700 |
| E 2.2 | E 1.4 | 1.5 | 2 | 2.5 | 449 | 328 | 1.5 | 6 900 |

COMPARATIVE EXAMPLES C3.0 TO C3.2 AND EXAMPLES 3.1 TO 3.3 RETANNING OF WET WHITE FURNITURE LEATHER

A Southern German cattle hide was converted into a wet white semifinished product, shaved to a thickness of 1.2 mm and cut into strips of about 250 g each.

In comparative example C3.0, the hide was treated for 40 minutes at 35° C. with 150% of water containing 3% of Relugan® GT 50, i.e. a formulation which substantially comprises an aqueous glutaraldehyde solution, and 0.5% of formic acid. Thereafter, treatment was effected for 60 minutes with 4% of a mixture consisting of equal parts of Tamol® NA and sodium formate and then drumming was effected with 4% of Relugan® SE and 5% of Basyntan® SW, i.e. sulfone tanning agent, for 20 minutes. Thereafter, 6% of the commercial vegetable tanning agent Tara and 2% of resin tanning agent Relugan® S and 2% of the dye Luganil® brown NGB were metered in and the mixture was drummed again. After 2 hours, the pH was brought to 3.6 with formic acid. The fatliquoring components added were 6% of Lipodermlicker® CMG and 1% of Lipamin® OK. After a drumming time of a further 60 minutes, acidification was once again effected with formic acid to pH 3.2 and, before the liquor was discharged, samples for the determination of the solids content thereof, i.e. the liquor exhaustion, were taken. The leathers were washed twice with 100% of water each time, stored moist overnight and, after partial drying, dried on a toggle frame at 50° C.

The liquor exhaustion and quality of the leather with respect to body, grain tightness, softness, levelness and embossing were rated according to a rating system from 1 (very good) to 5 (unsatisfactory). The assessment of the liquor exhaustion was effected visually according to the criteria of residual dye (extinction) and turbidity (fatliquoring agent). For assessing the embossing, the leather pieces were treated by the following procedure: finished and pressed with a platen press at 120 bar and from 80 to 100° C. for 5 seconds. The quality of the embossing was measured according to the criteria of embossing depth, levelness and memory after tensile loading.

No clay mineral was added in comparative example C3.0, the clay mineral corresponding to C1.1 was added in comparative example C3.1, i.e. kaolin having a mean particle size of 13.2 μm, and the clay mineral corresponding to comparative example C1.3 was added in comparative example C3.2, i.e. kaolin having a mean particle size of 5.1 μm.

The clay mineral corresponding to example E1.1 was added in example E3.1, i.e. a kaolin having a mean particle size of 1.3 μm, a clay mineral corresponding to example E1.2 was added in example 3.2, i.e. montmorillonite having a mean particle size of 0.6 μm, and the clay mineral corresponding to example E1.3 was added in example E3.3, i.e. a mixture of kaolin and montmorillonite having a bimodal mean particle size distribution, one fraction having a mean particle size of 0.6 μm and a second fraction having a mean particle size of 3.2 μm.

TABLE 3

| | Clay mineral | Liquor exhaustion | Body | Grain tightness | Softness | Tensile strength [N] | Stitch tear resistance [N] | Levelness | Embossing |
|---|---|---|---|---|---|---|---|---|---|
| C 3.0 | — | 3.0 | 3 | 3.5 | 3 | 268 | 192 | 3 | 3 |
| C 3.1 | C 1.1 | 4 | 3 | 3 | 3.5 | 248 | 188 | 2.5 | 3.5 |
| C 3.2 | C 1.3 | 3.5 | 2.5 | 2.5 | 3 | 259 | 194 | 2 | 3 |
| E 3.1 | E 1.1 | 2.5 | 2 | 2.5 | 2 | 277 | 201 | 1 | 2.5 |
| E 3.2 | E 1.2 | 2 | 2 | 1.5 | 2 | 284 | 223 | 1 | 1.5 |
| E 3.3 | E 1.3 | 1.5 | 1.5 | 2 | 2.5 | 289 | 218 | 1.5 | 1.5 |

The comparison of the results of comparative examples C3.0 to C3.2 and of the examples according to the invention E3.1 to E3.3 in table 3 shows an improvement in all quality features, i.e. body, grain tightness, softness, tensile strength, stitch tear resistance, levelness, embossing and liquor exhaustion.

We claim:

1. A method for chrome-free and chrome tanning, comprising contacting an animal hide with a formulation comprising:

a clay mineral, which, after vigorous stirring for 30 minutes in water at 50° C., has a number average particle diameter of less than 2 μm, or a bimodal size distribution with a first, finely divided fraction, whose number average particle diameter is less than 0.5 μm, and a second, coarser fraction, whose number average particle diameter is less than 5 μm, determined in each case by the method according to ISO 13320-1, by combined laser light diffraction and light scattering, and wherein, the amount of the first, finely divided fraction is from 10 to 90% by weight;

and one or more substances selected from the group consisting of organic polymers, aldehyde tanning agents, sulfone tanning agents, resin tanning agents, phenol tanning agents, fatliquoring agents, vegetable tanning agents, dyes, pigments and mixtures thereof, wherein the clay mineral is a phyllosilicate selected from the group consisting of kaolinite, smectite, muscovite, montmorillonite, bentonite, hectorite and mixtures thereof.

2. The method as claimed in claim 1, wherein the clay mineral is muscovite.

3. The method as claimed in claim 1, wherein the clay mineral is hectorite.

4. The method as claimed in claim 1, wherein said formulation comprises a clay mineral, which, after vigorous stirring for 30 minutes in water at 50° C., has a number average particle diameter of less than 2 μm determined by the method according to ISO 13320-1, by combined laser light diffraction and light scattering.

5. The method as claimed in claim 4, wherein the clay mineral has a number average particle diameter of less than 1 μm.

6. The method as claimed in claim 4, wherein said formulation further comprises one or more substances, which, owing to their chemical structure, are capable of forming strong hydrogen bridge bonds with the clay mineral.

7. The method as claimed in claim 6, wherein the one or more substances which, owing to their chemical structure, are capable of forming strong hydrogen bridge bonds with the clay mineral, are selected from the group consisting of urea or urea derivates, alcohols, polyols, propylene carbonate, organic amides, urethanes, saccharides or derivatives of saccharides, nitrocellulose, sulfite cellulose, ethylhexylcellulose, and mixtures thereof.

8. The method as claimed in claim 1, wherein the one or more substances are selected from aldehyde tanning agents, and wherein the aldehyde tanning agents are glutaraldehyde or a derivative of glutaraldehyde.

9. The method as claimed in claim 1, wherein the clay mineral has a number average particle diameter of less than 1 μm.

10. The method as claimed in claim 1, wherein the phyllosilicate is selected from the group consisting of kaolinite, montmorillonite, bentonite, and mixtures thereof.

11. The method as claimed in claim 1, wherein said animal hide is a tanned animal hide.

12. The method as claimed in claim 1, wherein said formulation comprises:

a clay mineral, which, after vigorous stirring for 30 minutes in water at 50° C., has a bimodal size distribution with a first, finely divided fraction, whose number average particle diameter is less than 0.5 μm, and a second, coarser fraction, whose number average particle diameter is less than 5 μm, determined in each case by the method according to ISO 13320-1, by combined laser light diffraction and light scattering, and wherein, the amount of the first, finely divided fraction is from 10 to 90% by weight.

13. The method as claimed in claim 12, wherein said formulation further comprises one or more substances, which, owing to their chemical structure, are capable of forming strong hydrogen bridge bonds with the clay mineral.

14. The method as claimed in claim 13, wherein the one or more substances which, owing to their chemical structure, are capable of forming strong hydrogen bridge bonds with the clay mineral, are selected from the group consisting of urea or urea derivates, alcohols, polyols, propylene carbonate, organic amides, urethanes, saccharides or derivatives of saccharides, nitrocellulose, sulfite cellulose, ethylhexylcellulose, and mixtures thereof.

* * * * *